US006958737B2

(12) United States Patent
Lee et al.

(10) Patent No.: US 6,958,737 B2
(45) Date of Patent: Oct. 25, 2005

(54) LOOP ANTENNA FOR A MOBILE TERMINAL CAPABLE OF REDUCING SPECIFIC ABSORPTION RATE

(75) Inventors: Ju-Hyung Lee, Kwachon-shi (KR); Yong-Jin Kim, Seoul (KR)

(73) Assignee: Samsung Electronics Co., Ltd., (KR)

( * ) Notice: Subject to any disclaimer, the term of this patent is extended or adjusted under 35 U.S.C. 154(b) by 13 days.

(21) Appl. No.: 10/811,548

(22) Filed: Mar. 29, 2004

(65) Prior Publication Data

US 2005/0007292 A1 Jan. 13, 2005

(30) Foreign Application Priority Data

Jun. 13, 2003 (KR) ..... 10-2003-0038358

(51) Int. Cl.[7] ..... H01Q 7/00
(52) U.S. Cl. ..... 343/866; 343/702
(58) Field of Search ..... 343/702, 866, 343/867, 846

(56) References Cited

U.S. PATENT DOCUMENTS 4,135,184 A * 1/1979 Pruzick ..... 340/572.5
4,731,867 A * 3/1988 Seabury et al. ..... 455/41.2
6,567,050 B1 * 5/2003 Briggs ..... 343/741
6,597,320 B2 * 7/2003 Maeda et al. ..... 343/718
6,603,440 B2 * 8/2003 Howard ..... 343/866
2003/0096637 A1 * 5/2003 Keller et al. ..... 455/562

* cited by examiner

*Primary Examiner*—Shih-Chao Chen
(74) *Attorney, Agent, or Firm*—Dilworth & Barrese LLP

(57) ABSTRACT

A loop antenna for a mobile terminal capable of reducing SAR. The loop antenna has three lines. The first line generates and transmits predetermined electric waves upon receiving current from an oscillator for oscillating power and has a connection point to connect an external line thereto. The second line includes a first end connected to a printed circuit board to ground current supplied to the first line and a second end having an opened structure. The third line has a first end connected to one side of the first line through the connection point and a second end connected to one side of the second line coupled to the printed circuit board in order to receive current from the first line through the connection point and transmit current into the second line.

5 Claims, 6 Drawing Sheets

LOOP ANTENNA FOR A MOBILE TERMINAL CAPABLE OF REDUCING SPECIFIC ABSORPTION RATE

PRIORITY

This application claims priority to an application entitled "Loop Antenna for Mobile Terminal Capable of Reducing Specific Absorption Rate" filed in the Korean Industrial Property Office on Jun. 13, 2003 and assigned Serial No. 2003-38358, the contents of which are hereby incorporated by reference.

BACKGROUND OF THE INVENTION

1. Field of the Invention

The present invention relates to an antenna for a mobile phone, and more particularly to an antenna for a mobile phone having an improved structure, which reduces specific absorption rate (hereinafter referred to SAR) with respect to an electronic circuit board, which is connected to the antenna and into which electromagnetic waves are absorbed as power is fed through the antenna.

2. Description of the Related Art

Recently, as wireless mobile terminals are widely used and various electronic industries have developed rapidly, devices for shielding electromagnetic waves that are harmful to the human body or reducing SAR have been developed. SAR is electromagnetic energy (W/Kg) absorbed into the human body per unit mass when a person uses a mobile terminal. SAR is a yardstick for representing an amount of electromagnetic waves absorbed into the human body and is used as a parameter for a human protection standard.

Generally, a mobile terminal is used closely to the human body, so SAR is affected by a near field region of waves radiated from an antenna of the mobile terminal. Therefore, SAR is closely related to the transmitting power of the mobile terminal, an antenna characteristic, and a structure of the mobile terminal.

Various methods have been developed to reduce SAR. For example, a directional antenna and a separate conductive plate are used to shield electromagnetic waves, and a wave absorption member is inserted into the mobile terminal.

SAR is measured as shown below in Equation 1

$$SAR=\sigma/2\rho|E\ i|^2 \qquad \text{Equation 1}$$

wherein, σ is an electric conductivity (S/m) of human tissue making contact with electromagnetic wave, Ei is an intensity (V/m) of am electric field penetrated into the human body, and ρ is a density of human tissue making contact with the electromagnetic wave.

If a high SAR is measured, it has a bad influence on the human body. Therefore, many countries have set a SAR reference value to a head of the human body in such a manner that the SAR may not exceed the reference value. In Korea, the SAR reference value is 1.6 (W/Kg), which is identical to that of the U.S.A. However, in Japan and the E.U., the SAR reference value is 2.0 (W/Kg).

Conventionally, an antenna of a mobile terminal is aligned as far from the human body as possible when a user makes communication using the mobile terminal in order to reduce SAR by the human body. FIGS. 1 and 2 illustrate conventional mobile terminals having antennas positioned away from the human body when making communication through the mobile terminals.

Referring to FIG. 1, a connection member 5 is installed at an outer portion of the mobile terminal. An antenna 3 is connected to the connection member 5 in such a manner that the antenna 3 is installed at the outer portion of the mobile terminal while being remotely positioned from a printed circuit board 10 by a predetermined distance. In this case, due to the connection member 5, the SAR according to current introduced into the printed circuit board 10 is about 1.89 (W/Kg). The SAR has been measured through an experiment and has a tolerance about ±0.1 (W/Kg).

Referring to FIG. 2, a connection member 9 is installed in the mobile terminal. In addition, an antenna 7 is installed at a rear portion of the mobile terminal through the connection member 9 while being spaced by a predetermined distance from a printed circuit board 10. In this case, due to the connection member 9, the SAR according to current introduced into the printed circuit board 10 of the mobile terminal is about 0.82 (W/Kg). The SAR is measured through an experiment and has a tolerance about ±0.1 (W/Kg).

Although the above structures can ensure a predetermined distance between the antenna and the mobile terminal, current also flows through the printed circuit board 10 of the mobile terminal for feeding power to the antenna. Accordingly, the printed circuit board 10 acts as an antenna. Thus, the predetermined distance ensured between the antenna and the mobile terminal is meaningless. That is, even though a predetermined distance is set between the antenna and the mobile terminal, power fed to the antenna is flowing back into the printed circuit board, thereby generating electromagnetic waves in the printed circuit board.

Therefore, although the above structures ensure a sufficient distance between the antenna and the mobile terminal for reducing SAR, a real value of SAR exceeds the above experimental values due to current flowing through the printed circuit board.

In order to prevent current from flowing through the printed circuit board from the antenna, a method has been suggested for installing a balun 14 in the form of a choke between an antenna 12 and a printed circuit board 10 as illustrated in FIG. 3. However, according to the above method, the antenna 12 is spaced far from the mobile terminal due to the balun 14, thereby deforming an outer appearance of the mobile phone. Therefore, it is impractical to mount the antenna 12 by using the balun 14.

SUMMARY OF THE INVENTION

Accordingly, the present invention has been designed to solve the above and other problems occurring in the prior art, and an object of the present invention is to provide a loop antenna for a mobile terminal capable of reducing SAR, which is increased due to current flowing through a printed circuit board, by reducing the current flowing into the printed circuit board from the loop antenna.

Another object of the present invention is to provide a loop antenna for a mobile terminal capable of maintaining an outer appearance of the mobile terminal even if a connection style and a structure of the loop antenna are varied to reduce SAR, which is increased due to current flowing through a printed circuit board.

In order to accomplish the above and other objects, there is provided a loop antenna for a mobile terminal, the loop antenna comprising: a first line for generating and transmitting predetermined electric waves upon receiving current from an oscillator for oscillating power, and having a connection point at one side thereof so as to connect an external line thereto; a second line including a first end connected to a printed circuit board to ground current supplied to the first line and a second end having an opened structure; and a third line having a first end connected to a side of the first line through the connection point and a second end connected to a side of the second line coupled to the printed circuit board in order to receive current from the first line through the connection point and transmit current into the second line.

According to the preferred embodiment of the present invention, the second line is spaced from the first line by a uniform interval. The first line is overlapped with the second line, thereby forming a dual stack structure. Preferably, the second line is arranged symmetrically to the third line. The first to third lines are accommodated in the mobile terminal.

According to the present invention, current flowing through the first line, which is a part of the loop antenna, is transmitted into the second line through the third line connected to the second line without feeding current through the third line, which is a part of the loop antenna. Therefore, current supplied into the first line from the oscillating section is introduced into the second line without being grounded to the oscillating section, and current is not introduced into the printed circuit board having the oscillating section. Accordingly, the SAR, which results from current flowing through the printed circuit board, can be reduced.

BRIEF DESCRIPTION OF THE DRAWINGS

The above and other objects, features, and advantages of the present invention will be more apparent from the following detailed description taken in conjunction with the accompanying drawings, in which.

DETAILED DESCRIPTION OF THE PREFERRED EMBODIMENT

Figure 1:
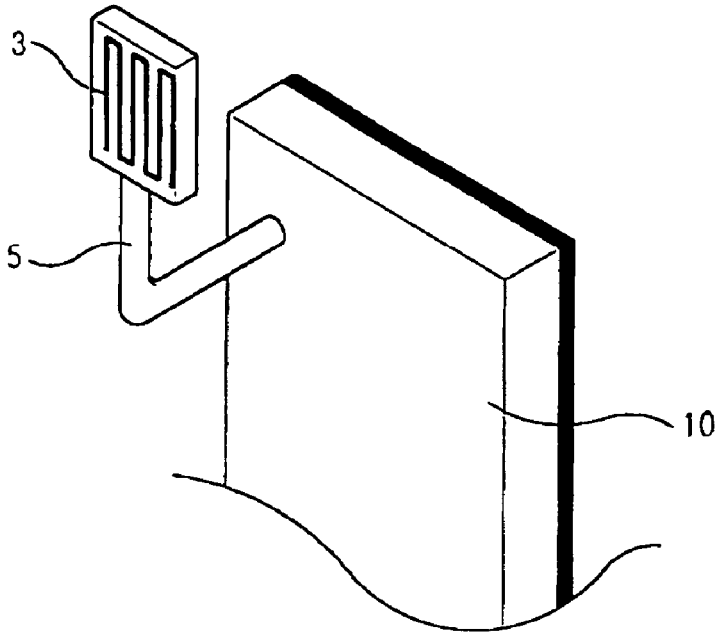
FIG. 1 (PRIOR ART)
FIGS. 1 and 2 are perspective views illustrating conventional mobile terminals designed to ensure a sufficient distance between an antenna and a human body.
Figure 2:
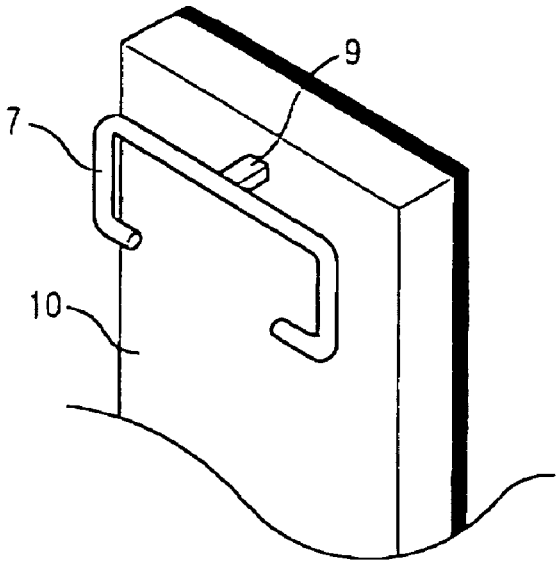
FIG. 2 (PRIOR ART)
Figure 3:
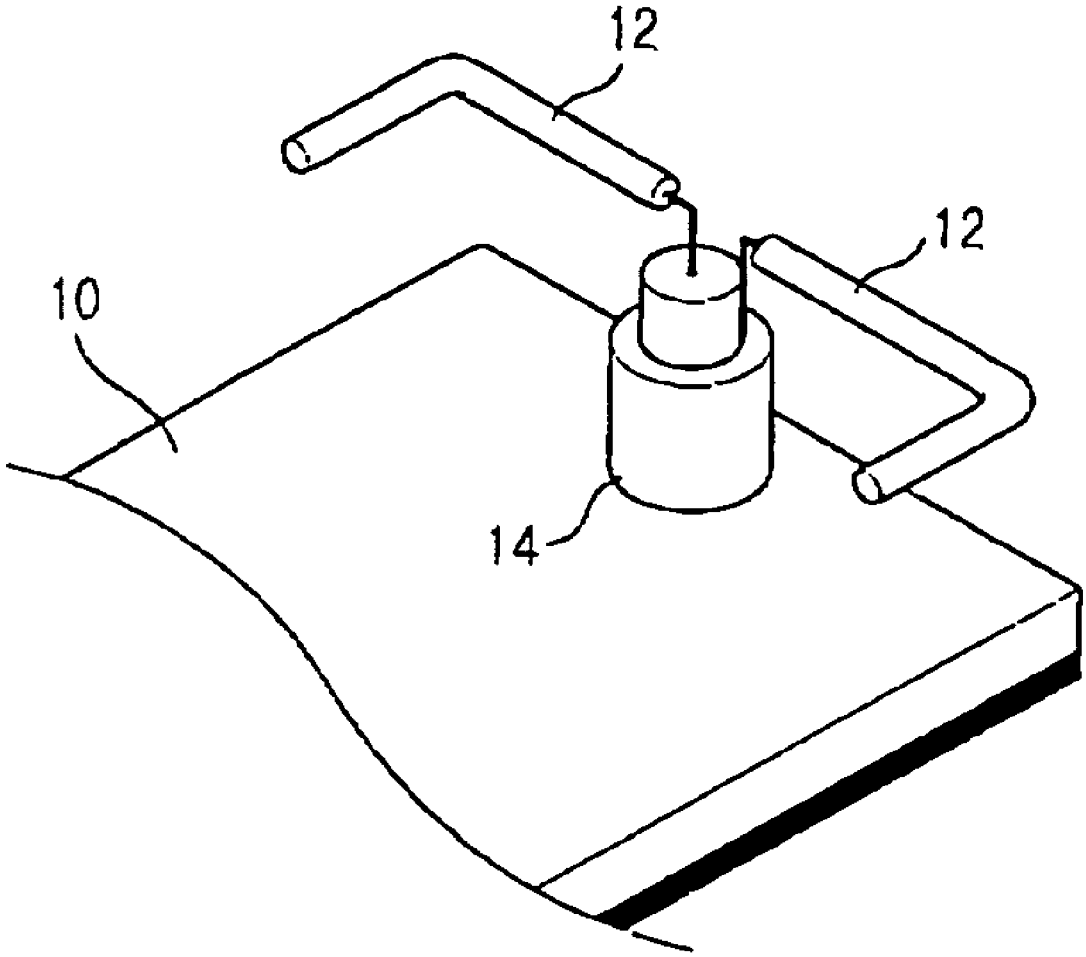
FIG.3 (PRIOR ART)
FIG. 3 is a perspective view illustrating another conventional mobile terminal designed for preventing current from flowing into a printed circuit board from an antenna.

Preferred embodiments of the present invention will be described in detail hereinbelow with reference to the accompanying drawings. In the following description of the present invention, the same reference numerals are used to designate the same or similar components and a detailed description of known functions and configurations incorporated herein will be omitted when it may make the subject matter of the present invention rather unclear. In addition, it will be understood by those skilled in the art that specific components and structures described in the following description, such as devices forming a circuit, do not intend to limit the scope of the present invention, but intend to explain the present invention.

Figure 4:
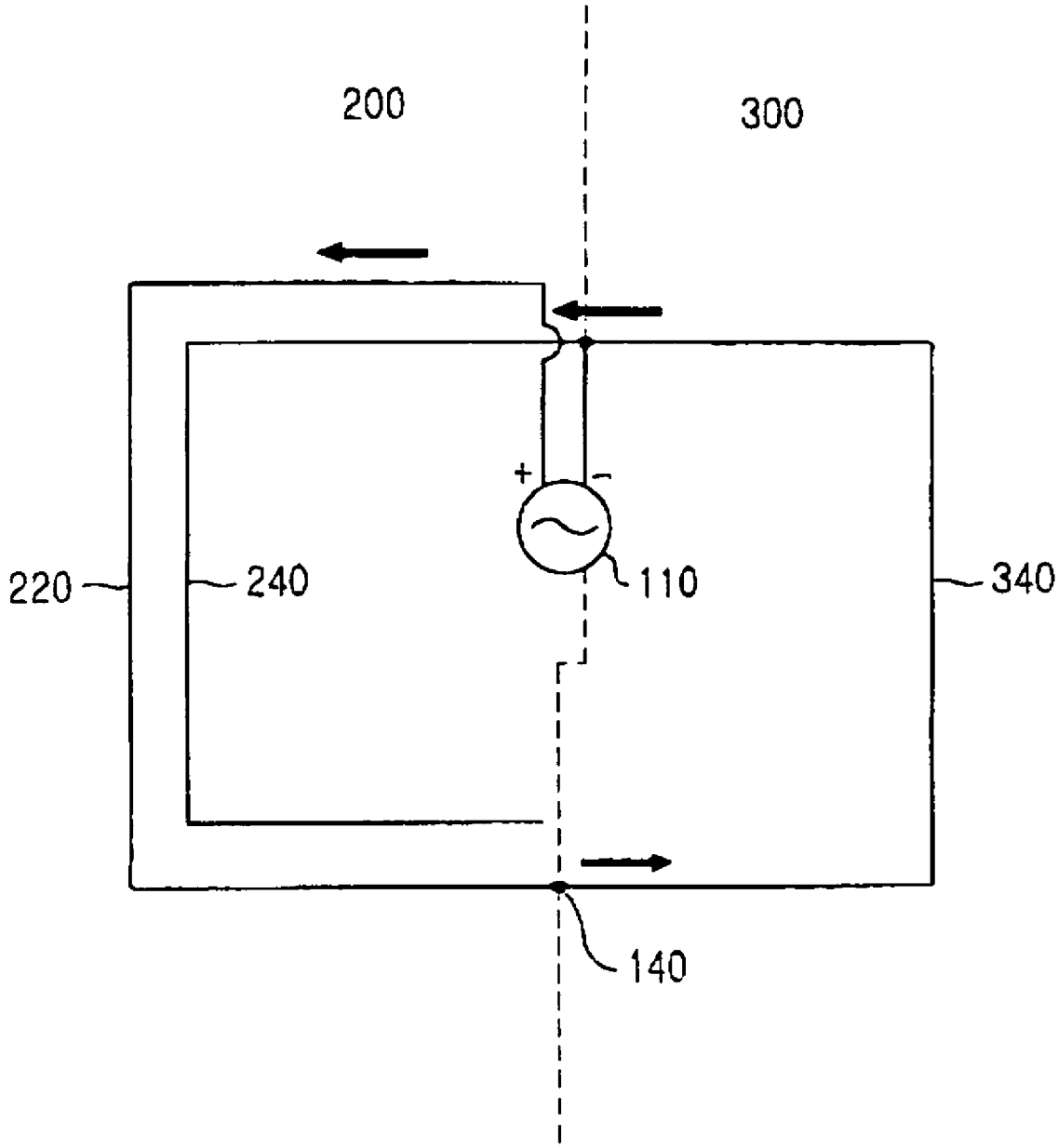
FIG. 4 is a circuit view of a loop antenna for a mobile terminal capable of reducing SAR, which results from current flowing through a printed circuit board, according to one embodiment of the present invention.

FIG. 4 is a circuit view of a loop antenna for a mobile terminal capable of reducing SAR, which results from current flowing through a printed circuit board, according to a preferred embodiment of the present invention. As illustrated in FIG. 4, the loop antenna includes a first part 200 and a second part 300. That is, the first part 200 of the loop antenna has a first line 220 used as a transmission line and a second line 240 for discharging current flowing through the first line 220. The second part 300 of the loop antenna has a third line 340 including a first end connected to the first line 220 of the first part 200 and a second end connected to the second line 240 of the first part 200. The first line 220 emits electric waves as current generated from an oscillating section 110 flows through the first line 220. Current having a predetermined percent value of current charged through the first line 220 is fed back into the second line 240. Current flowing through the first line 220 of the first part 200 is introduced into the third line 340 through a connection point 140, to which the first line 220 of the first part 200 and the third line 340 of the second part 300 are connected. Current introduced into the third line 340 is transmitted into the second line 240 of the first part without being grounded to the oscillating section 110. In practice, the first and second lines 220 and 240 are designed to be aligned in a dual stack structure.

Because current transmitted into the first line 220 is transferred into the second line 240 through the third line 340, current supplied from the oscillating section 110 flows through the second line 240 without being grounded to the oscillating section 110, so that current is not introduced into a printed circuit board (not shown).

Figure 5:
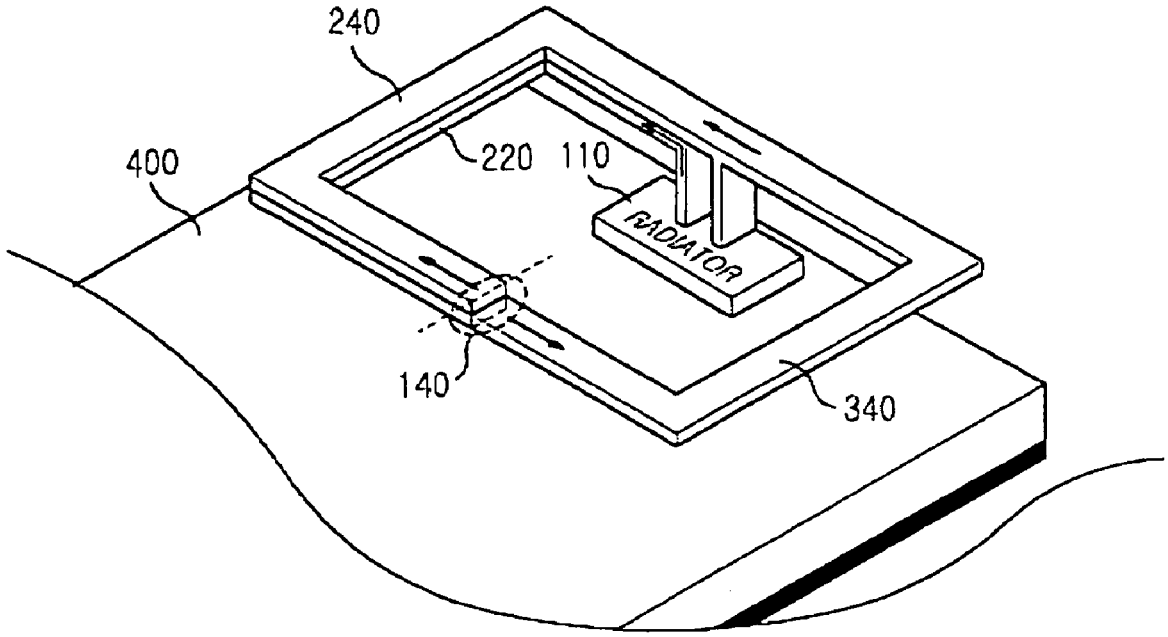
FIG. 5 is a perspective view illustrating an example of a loop antenna connected to a printed circuit board of a mobile terminal.

FIG. 5 is a perspective view illustrating an example of the loop antenna connected to the printed circuit board of the mobile terminal. The loop antenna is connected to a printed circuit board 400 having the oscillating section 110 for supplying power to the loop antenna and installed in a mobile terminal when the mobile terminal is produced as a finished product.

Referring to FIG. 5, first and second lines 220 and 240 are aligned in a dual stack structure. Power generated from the oscillating section 110 of the mobile terminal is supplied into the first line 220. Upon receiving power from the oscillating section 110, the first line 220 transmits electric waves by using current of supplied power. Current flowing through the first line 220 is transmitted into the third line 340 of the second part 300 through the connection point 140. Current flowing through the third line 340 is transmitted into the second line 240 of the first part 200 without being introduced into a ground line of the oscillating section 110. Thus, current is not introduced into the printed circuit board 400, so that SAR caused by current flowing through the printed circuit board 400 can be reduced. At this time, a length of the loop antenna may vary.

Figure 6A:
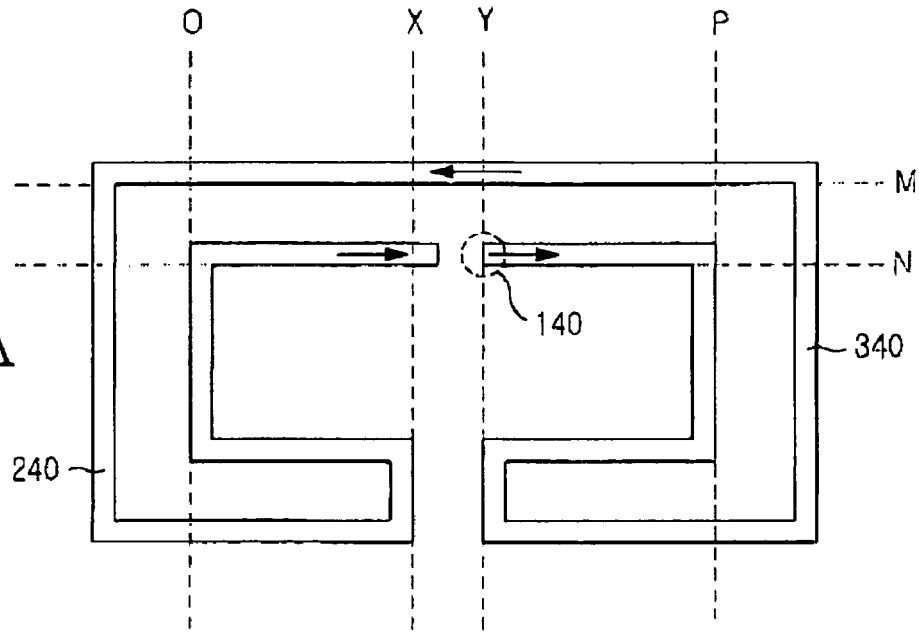
FIGS. 6A and 6B are schematic views illustrating an upper surface and a lower surface of a loop antenna, respectively, according to another embodiment of the present invention.
Figure 6B:
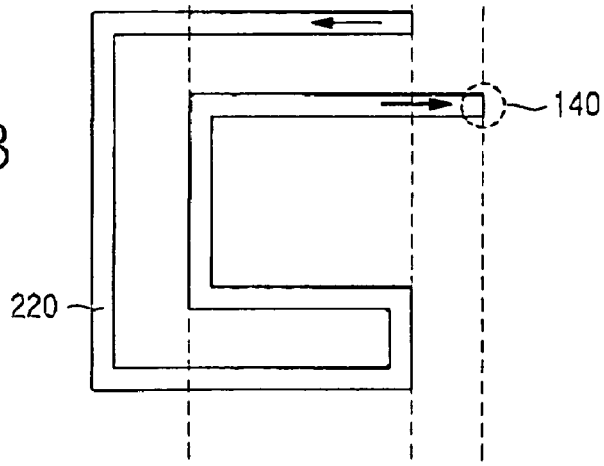

FIGS. 6A and 6B are schematic views illustrating a loop antenna according to another embodiment of the present invention. FIGS. 6A and 6B represent upper and lower structures of the loop antenna, respectively. It should be noted, however, that the positions of the upper and lower structures in the loop antenna illustrated in FIGS. 6A and 6B can be changed with each other.

Referring to FIG. 6A, current flowing through the connection point 140 is introduced into the second line 240 through the third line 340. Thus, current introduced into the third line 340 is transmitted into the second line 240 without being introduced into the printed circuit board. The second and third lines 240 and 340 are connected to ground power supplied from the printed circuit board. Thus, SAR caused by current flowing through the printed circuit board is reduced.

Referring to FIG. 6B, the first line 220 is used as a transmission line and generates electric waves when current is applied thereto from the printed circuit board. At this time, the first line 220 can be overlapped with the second line 240 while forming a dual structure. That is, the first and second lines 220 and 240 are aligned in a dual stack structure. Current flowing through the first line 220 is introduced into the third line 340 through the connection point 140. Then, current is transmitted into the second line 240. As a result, current supplied into the first line 220 is not introduced into the printed circuit board so that SAR caused by current flowing through the printed circuit board can be reduced.

Figures 7A, 7B:
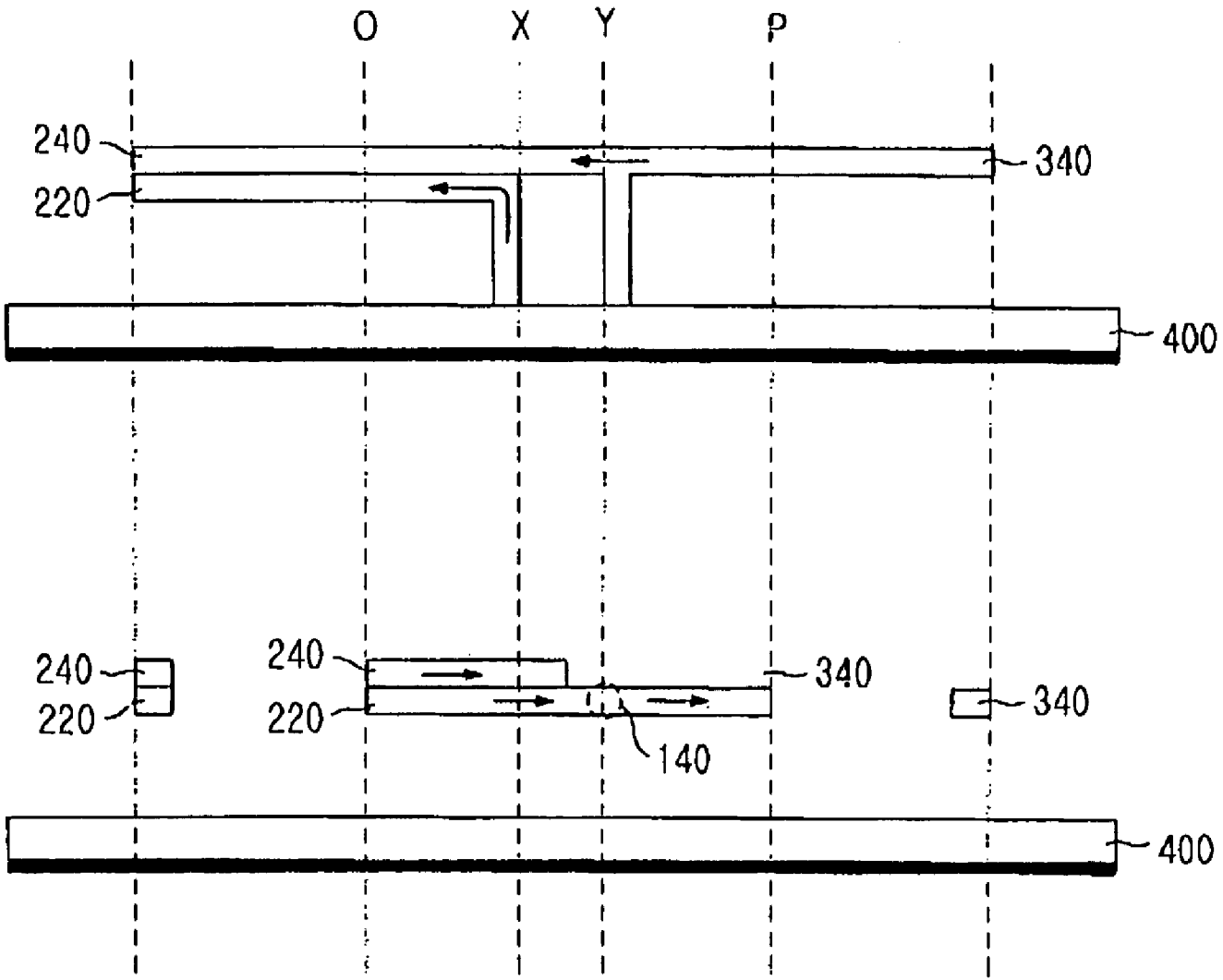
FIGS. 7A and 7B are sectional views of a loop antenna taken along lines M and N illustrated in FIGS. 6A and 6B, respectively.

FIGS. 7A and 7B are sectional views of the loop antenna taken along lines M and N illustrated in FIGS. 6A and 6B, respectively. As illustrated in FIG. 7A, the first line 220 is connected to the printed circuit board 400 and current is transmitted into the first line 220 from the printed circuit board 400. The second line 240 forming a dual stack structure together with the first line 220 and the third line connected to the first line through the connection point 140 are grounded through the printed circuit board 400.

As indicated above, FIG. 7B is a sectional structure of the loop antenna taken along lines N. Referring to FIG. 7B, first to third lines 220, 230 and 240 are arranged spaced from the printed circuit board 400 by a predetermined distance. In addition, the first line 220 is connected to the third line 340 through the connection point 140. Thus, current flowing through the first line 220 is transmitted into the third line 340 through the connection point 140.

Although it is preferred to design the second and third lines 240 and 340 to have a structure symmetrical with each other, the structures of the second and third lines 240 and 340 can be varied in order to prevent current from flowing into the printed circuit board.

According to the present invention, current flowing through the first line, which is a part of the loop antenna, is transmitted into the second line through the third line connected to the second line without feeding current through the third line, which is a part of the loop antenna, so current supplied into the first line from the oscillating section is introduced into the second line without being grounded to the oscillating section, and current is not introduced into the printed circuit board having the oscillating section. Accordingly, the SAR, which is caused by current flowing through the printed circuit board, can be reduced.

While the present invention has been shown and described with reference to certain preferred embodiments thereof, it will be understood by those skilled in the art that various changes in form and details may be made therein without departing from the spirit and scope of the invention as defined by the appended claims.

What is claimed is:

1. A loop antenna for a mobile terminal, the loop antenna comprising:

a first line for generating and transmitting predetermined electric waves upon receiving current from an oscillator for oscillating power, and including a connection point to connect an external line thereto;

a second line including a first end connected to a printed circuit board to ground current supplied to the first line and a second end having an opened structure; and a third line having a first end connected to the first line at the connection point and a second end connected to the second line coupled to the printed circuit board in order to receive the current from the first line through the connection point and transmit the current into the second line.

2. The loop antenna as claimed in claim 1, wherein the second line is spaced from the first line by a uniform interval.

3. The loop antenna as claimed in claim 1, wherein the first line and the second line form a dual stack structure.

4. The loop antenna as claimed in claim 1, wherein the second line is arranged symmetrically to the third line.

5. The loop antenna as claimed in claim 1, wherein the first, second, and third lines are accommodated in the mobile terminal.

* * * * *